US006345424B1

(12) United States Patent
Hasegawa et al.

(10) Patent No.: US 6,345,424 B1
(45) **Date of Patent: *Feb. 12, 2002**

(54) PRODUCTION METHOD FOR FORMING LIQUID SPRAY HEAD

(75) Inventors: Kazumasa Hasegawa; Masato Shimada; Masayuki Sawada, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/460,876

(22) Filed: Jun. 5, 1995

Related U.S. Application Data

(62) Division of application No. 08/168,554, filed on Dec. 15, 1993, now Pat. No. 5,530,465, which is a continuation of application No. PCT/JP93/00524, filed on Apr. 23, 1993.

(30) Foreign Application Priority Data

| | | |
|---|---|---|
| Apr. 23, 1992 | (JP) | 4-104762 |
| Oct. 19, 1992 | (JP) | 4-280091 |
| Jan. 25, 1993 | (JP) | 5-010226 |
| Feb. 18, 1993 | (JP) | 5-029330 |
| Mar. 17, 1993 | (JP) | 5-057430 |
| Mar. 30, 1993 | (JP) | 5-072426 |

(51) Int. Cl.[7] ..... H04R 17/00; G10D 15/20

(52) U.S. Cl. ..... 29/25.35; 29/890.1; 29/DIG. 16; 216/27

(58) Field of Search ..... 347/68, 70, 71, 347/45, 40, 54; 29/25.35, 890.1, DIG. 16, DIG. 29; 216/27, 17, 79

(56) References Cited

U.S. PATENT DOCUMENTS

| | | |
|---|---|---|
| 4,312,008 A | 1/1982 | Taub et al. |
| 4,520,374 A | 5/1985 | Koto |
| 4,525,728 A | 6/1985 | Koto |

(List continued on next page.)

FOREIGN PATENT DOCUMENTS

| | | | |
|---|---|---|---|
| JP | 156073 | 12/1980 | |
| JP | 56-164582 | * 12/1981 | ..... 29/25.35 |
| JP | 113940 | 7/1982 | |
| JP | 5271 | 1/1983 | |
| JP | 102775 | 6/1983 | |
| JP | 59-23612 | * 2/1984 | ..... 29/25.35 |
| JP | 22790 | 5/1987 | |
| JP | 33076 | 7/1987 | |
| JP | 104844 | 5/1988 | |
| JP | 149159 | 6/1988 | |
| JP | 219654 | 9/1990 | |
| JP | 258261 | 10/1990 | |
| JP | 124450 | 5/1991 | |
| JP | 297653 | 12/1991 | |
| JP | 43435 | 7/1992 | |

OTHER PUBLICATIONS

Japanese Journal of Applied Physics, vol. 30, No. 12B, Dec. 1991, pp. 3562–3566, _Single–Target Sputtering Process for Lead Zirconate Titanate Thin Films With Precise Composition Control, by Kazuyoshi Torii et al.

*Primary Examiner*—Lee Young
*Assistant Examiner*—A. Dexter Tugbang
(74) *Attorney, Agent, or Firm*—Sughrue Mion, PLLC

(57) ABSTRACT

A production method for forming a liquid spray head. A diaphragm is formed on a first surface of a substrate made of planar oriented (110) monocrystalline silicon. A piezoelectric element is formed by laminating a first electrode, a piezoelectric film and a second electrode arranged on the diaphragm. A liquid chamber is formed by etching so that is extends in one of the <1I2> direction and the <I12> direction at a predetermined position on a second surface of the substrate, which opposes the first surface thereof.

14 Claims, 6 Drawing Sheets

U.S. PATENT DOCUMENTS 4,546,362 A 10/1985 Koto
4,651,120 A * 3/1987 Aagard ..... 29/25.35
4,783,821 A * 11/1988 Muller et al. ..... 29/25.35
4,912,822 A * 4/1990 Zdeblick et al. ..... 29/25.35
4,947,184 A 8/1990 Moynihan
5,193,256 A * 3/1993 Ochiai et al. ..... 29/25.35
5,244,537 A * 9/1993 Ohnstein ..... 216/79
5,265,315 A * 11/1993 Hoisington et al. ..... 29/25.35
5,266,964 A * 11/1993 Takahashi et al. ..... 29/25.35
5,325,012 A * 6/1994 Sato et al. ..... 310/364
5,622,748 A * 4/1997 Takeuchi et al. ..... 29/25.35
5,631,040 A * 5/1997 Takuchi et al. ..... 29/25.35
5,637,126 A * 6/1997 Ema et al. ..... 216/27
5,719,607 A * 2/1998 Hasegawa et al. ..... 347/70
5,853,514 A * 12/1998 Takeuchi et al. ..... 29/25.35
5,922,218 A * 7/1999 Miyata et al. ..... 216/27

* cited by examiner

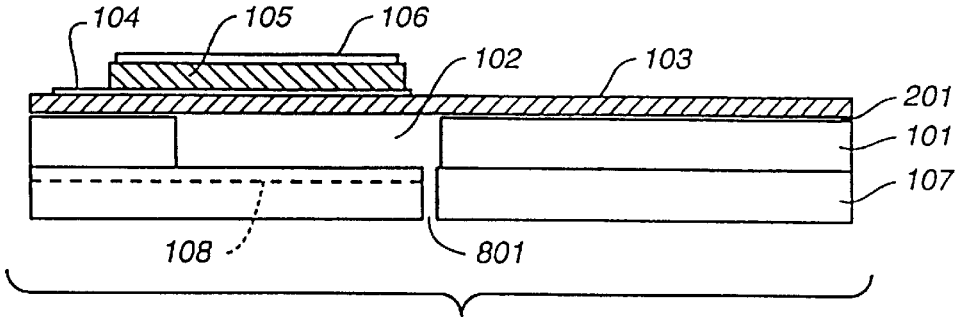
FIG._8B
FIG._9
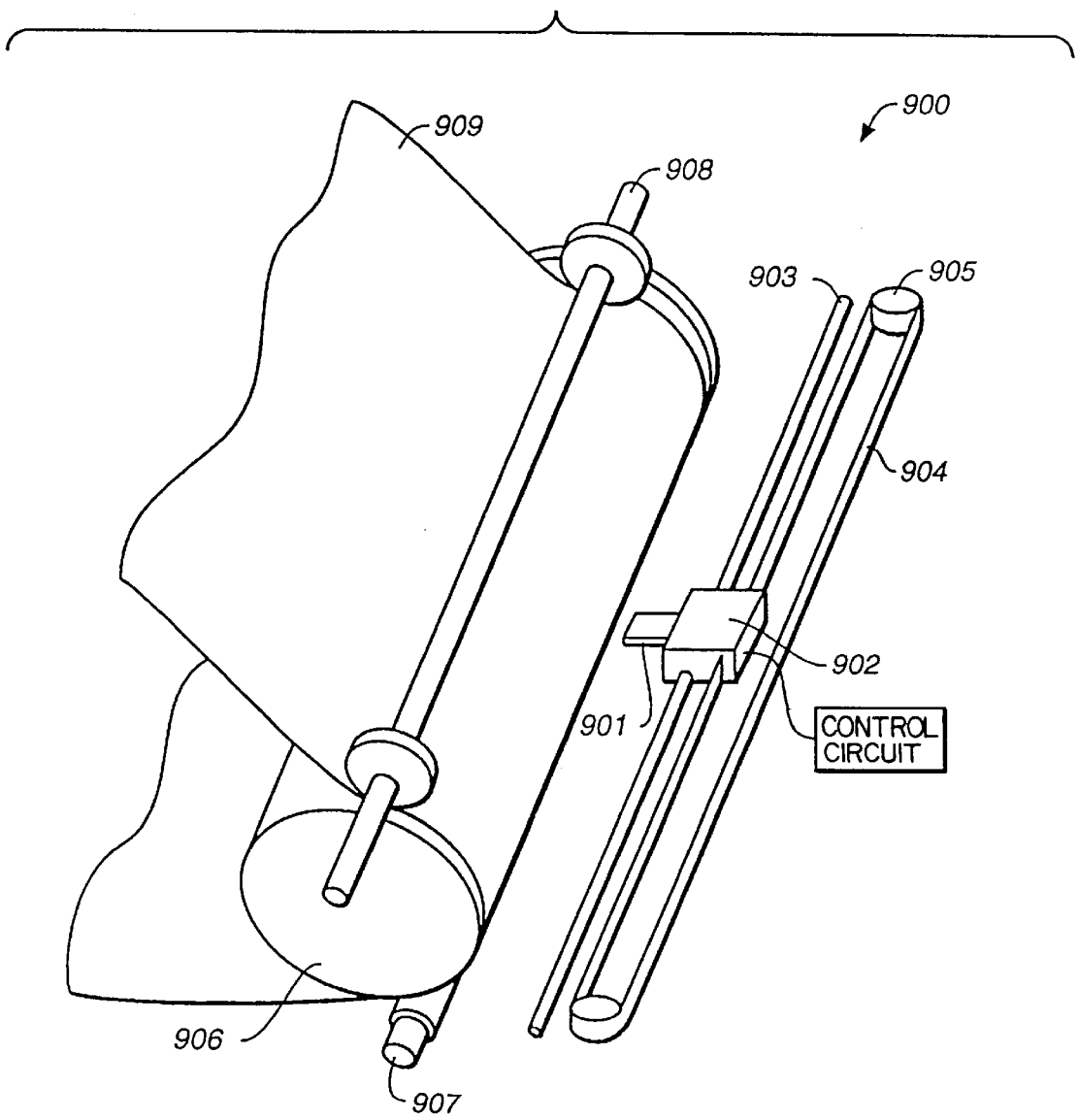

PRODUCTION METHOD FOR FORMING LIQUID SPRAY HEAD

CROSS REFERENCE TO RELATED APPLICANT

This is a divisional of application Ser. No. 08/168,554 filed Dec. 15, 1993, now U.S. Pat. No. 5,530,465 which in turn is a continuation of International Application No. PCT/JP93/00524 filed Apr. 23, 1993.

FIELD OF THE INVENTION

The present invention relates generally to a liquid spray head preferably used in a liquid spray recording apparatus and a production method thereof. In particular, the present invention relates to a liquid spray head having a piezoelectric element that pressurizes the liquid chamber and its production method.

BACKGROUND OF THE INVENTION

Generally, liquid spray recording apparatuses employ a liquid spray head comprising a liquid chamber, nozzles, liquid paths and an ink supply system. Such apparatuses are utilized by applying energy to the ink filled in the liquid chamber causing the ink stored therein to be ejected out through the liquid paths. As a result of this ejection, ink drops are sprayed from the nozzles, whereby character and graphic information or the like is recorded on a recording medium. A means that pressurizes the chamber, by way of example, a piezoelectric element or a heater for heating the ink in the liquid chamber, is used to the apply energy to the ink.

Conventional liquid spray heads similar to that described above and components related thereto are discussed in Japanese Patent Publication No. 62-22790, Japanese Laid-Open Patent Application 2-219654, U.S. Pat. No. 4,312,008, *Japanese Journal of Applied Physics,* Vol. 30, No. 12B, December 1991, pp. 3562–3566 by Torii, et al., Japanese Patent Publication No. 4-43435, and Japanese Laid-Open Patent Application 3-124450.

Japanese Patent Publication No. 62-22790 relates to a production method for a liquid spray head that forms an electrode on a substrate, which is fabricated as a thin layer in a location corresponding to the liquid chamber. A lead zirconate titanate (PZT) thin film is formed at a location corresponding to the liquid chamber by a sputtering, printing or other thin-film formation techniques.

In Japanese Laid-Open Patent Application 2-219654, a liquid spray head is provided with liquid chambers and liquid paths formed on a thin plate laminated on a semiconductor substrate provided with nozzles. A diaphragm is laminated above the liquid chambers and a piezoelectric vibrator is provided on the top portion of the diaphragm. Japanese Laid-Open Patent Application 2-219654 also relates to a production method for a liquid spray head that forms nozzles on a semiconductor substrate. In such a method, a dry film is adhered on the semiconductor substrate, and a diaphragm, a lower electrode, a piezoelectric film and an upper electrode are laminated thereon. The dry film is then removed by conventional means to complete this process.

In U.S. Pat. No. 4,312,008, a liquid spray head is fabricated by providing liquid paths formed in a substrate surface and liquid chambers which pass through the substrate. A substrate is adhered to both surfaces of the substrate and a piezoelectric element is provided thereon.

The Torii, et al. reference merely relates to the use of platinum for the lower electrode of a PZT thin film.

In Japanese Patent Publication No. 4-43435, an electrode formation method for a piezoelectric thin film is discussed in which a metal thin film base and a platinum film are formed on an insulating thin film. The films are heated at a temperature that causes the surface of the platinum thin film to become uneven due to crystal grain growth.

In Japanese Laid-Open Patent Application 3-124450, submitted by the inventors of the present invention, a production method for a liquid spray head is disclosed in which nozzles are formed from one surface of a monocrystalline silicon substrate. As disclosed therein, a p-type monocrystalline silicon is grown by epitaxy and a piezoelectric element is formed on the other surface of the monocrystalline silicon substrate. The p-type silicon layer and the monocrystalline silicon substrate are then etched, and the liquid chambers, a cantilever and center type diaphragms are formed therein.

However, the above prior art liquid spray heads, their component elements and their production methods have various deficiencies, as explained hereinbelow.

In the Japanese Patent Publication No. 62-22790, it is clear that though the thickness of the component elements is not clearly specified, in the embodiments the thickness of the PZT, tp, is believed to be 50 $\mu$m and the diaphragm thickness, tv, is believed to be from 50 to 100 $\mu$m. Accordingly, it is apparent that Japanese Patent Publication No. 62-22790 could not teach or suggest that the sum of tp+tv should be less than about 10 $\mu$m. However, if tp+tv is about 100 $\mu$m, as suggest by this reference, the amount of deformation in the diaphragm when a voltage is applied to the PZT is small and inadequate to reliably eject ink from such a liquid spray head. This is a result of the thicknesses of the diaphragm and the PZT layer being too large. Thus, in order to sufficiently deform the volume of the liquid chamber to facilitate the spraying of liquid, a round liquid chamber with about a 2 mm diameter is said to be required. However, in order to increase the resolution in such an apparatus, a planar configuration results in which the liquid chamber pitch is greater than the nozzle pitch as described therein. Such an arrangement results in poor surface area utilization. That is, the planar size of a liquid spray head with seven nozzles is about 20 mm×15 mm. As such, if the number of nozzles is increased, not only does the planar size becomes larger, but the speed of the liquid spray operation decreases significantly because the liquid paths linking the liquid chambers and nozzles becomes longer and greatly increases the liquid path resistance.

Moreover, in a method for making such a liquid spray head, a thin diaphragm is fabricated at a position corresponding to the liquid chambers and a PZT layer is formed above the diaphragm. However according to experiments performed by the inventors, when tp+tv was made thinner than specified, e.g., tp substantially equal to 3 $\mu$m and tv substantially equal to 1 $\mu$m, and the PZT layer was formed after fabricating the liquid chambers and diaphragm, the liquid spray head exhibited sag, wrinkles, breaking, etc., during the production process. This resulted in significantly reduced production yields of the liquid spray head.

Referring to Japanese Laid-Open Patent Application 2-219654, the nozzles in this reference are formed by machining the planar oriented (100) Si substrate. For example, when the nozzles are formed by anisotropic etching of the (100) Si substrate to a thickness of about 300 $\mu$m, even though the nozzle dimension is 30 $\mu$m square, the angular relationship with the (111) surface which has a slow etching rate unavoidably results in an opening about 400 $\mu$m square on the opposite substrate surface. Therefore, it is difficult to make the nozzle pitch less than 400 $\mu$m and, thus, the highest resolution possible is only about 60 dots per inch (dpi). That is, it is impossible to increase the density of the nozzles on the liquid spray head in an apparatus according to Japanese Laid-Open Patent Application 2-219654.

Further, as discussed therein, the piezoelectric film and upper and lower electrodes are both larger than the liquid chambers. Accordingly, in such a configuration, it is difficult at best to efficiently deform the diaphragm and spray liquid when voltage is applied to the piezoelectric film. Also, this reference is silent as to the size or thickness of the piezoelectric film, the upper and lower electrodes and the liquid chambers required to efficiently spray liquid.

Finally, in Japanese Laid-Open Patent Application 2-219654, a single $SiO_2$ layer is used as the diaphragm. As will be understood by one of ordinary skill in the art, $SiO_2$ has a small Young's modulus of approximately $10^{10}$ N/m$^2$. Accordingly, when a piezoelectric thin film is formed above the $SiO_2$ layer and the piezoelectric thin film is deformed laterally by applying a voltage, although it extends a fair distance laterally, its longitudinal deformation is not very great. That is, when one $SiO_2$ layer is used as the diaphragm, it is impossible to efficiently deform the diaphragm and reliably spray liquid when voltage is applied to the piezoelectric film. Japanese Laid-Open Patent Application 2-219654 is silent regarding the diaphragm characteristics or material required for efficiently spraying a liquid.

U.S. Pat. No. 4,312,008, fails to discuss a configuration in which a piezoelectric crystal is affixed to the top of the diaphragm. U.S. Pat. No. 4,312,008 discusses an embodiment of attachment of the piezoelectric crystal by means of an indium-based solder. As is apparent, the piezoelectric element being used is thicker than disclosed in Japanese Patent Publication No. 62-22790. Therefore, as in Japanese Patent Publication No. 62-22790, the nozzles essentially cannot be fabricated with a sufficiently high enough density. U.S. Pat. No. 4,312,008 also discusses, when using anisotropic etching to form the liquid paths, that the path shape is determined by the surface orientation of the Si substrate and cannot be freely selected. For example, when (100) Si is used, the cross-sectional shape of the liquid path is an inverted triangle, while when (110) Si is used, the cross-sectional shape of the liquid path is rectangular. Such cross-sectional shapes have various deficiencies. More specifically, when the liquid path is an inverted triangle, bubbles readily build up which results in poor quality printing. On the other hand, if the liquid path is a rectangular, the depth is difficult to control, and deviations occur in the liquid spray characteristic.

Further, undercut etching unavoidably occurs where the liquid paths and liquid chambers intersect, which results in an irregular intersection and an inconsistent liquid spray characteristic. In addition to this, since two substrates for sealing the Si substrate and two attachment processes are required in this conventional example, the production process is more complicated and production costs are increased.

In *Japanese Journal of Applied Physics,* Vol. 30, No. 12B, December 1991, pp. 3562–3566, Torii, et al., a platinum film is formed directly on $SiO_2$ as the lower electrode of the PZT film. However, in this type of configuration, it is well known that there is a problem with the bond between the silicon oxide and the platinum. Experiments conducted by the inventors confirmed that separation occurred between the silicon oxide and the platinum in heat treatment during or after PZT film formation or during operation after completion. Also, as discussed in Japanese Patent Publication 4-43435, it is known that titanium can be introduced between the platinum and the insulating material to improve the adherence between the silicon oxide or other insulating material and platinum and thereby solve the above problem. However, protrusions occur in the platinum surface in the heat treatment during or after formation of the PZT film and this lowers the breakdown voltage of the PZT film. As a result, spray heads fabricated in this fashion are somewhat more unreliable.

In Japanese Laid-Open Patent Application 3-124450 a configuration is shown in which the etching solution automatically circulates to the surface on the side facing the piezoelectric element when anisotropy etching of the monocrystalline silicon substrate is performed. This configuration results in side etching of the piezoelectric element by the anisotropic etching solution, e.g., potassium hydroxide aqueous solution, of the monocrystalline silicon substrate. Spray head fabricated in accordance with this process, have a lower yield.

OBJECTS OF THE INVENTION

It is an object of the present invention to provide a liquid spray head that obviates the aforementioned problems of the conventional liquid spray head.

It is a further object of the present invention to provide a method of producing liquid spray heads in accordance with the present invention.

It is another object of the to provide a spray head that facilitates efficient liquid spray operation and features planar compactness such that high nozzle density may be obtained even when the number of nozzles is increased.

It is still another object of the present invention to provided a liquid spray head that realizes a lower electrode with a low protrusion density on the surface and a PZT film having a high breakdown voltage for improving the liquid spray characteristics.

It is a further object of the present invention to provide a liquid spray head in which it easy to control the shape and depth of the liquid chambers and liquid paths, has no bubble buildup or deviation in the liquid spray characteristics, and increases the freedom of design.

It is still a further object of the present invention to provide a liquid spray head production method that achieves a high production yield even when a thin diaphragm and piezoelectric element are formed in order to realize a liquid spray head according to the present invention.

These and other objects, features and advantages of the present invention will become more apparent upon a consideration of the following detailed description of the preferred embodiments of the present invention in conjunction with the accompanying drawings.

Although the detailed description and annexed drawings describe a number of preferred embodiments of the present invention, it should be appreciated by those skilled in the art that many variations and modifications of the present invention fall within the spirit and scope of the present invention as defined by the appended claims.

SUMMARY OF THE INVENTION

According to an aspect of the present invention a liquid spray head is provided with a plurality of liquid spray elements arranged in an array on a substrate. Each element comprises a chamber arranged on the substrate for holding a liquid to be sprayed, a nozzle; a liquid path for communication with the nozzle and the chamber, a diaphragm arranged on the liquid chamber, a piezoelectric element comprising a lower electrode arranged on the diaphragm, a piezoelectric film comprising a lead zirconate titanate film arranged on the lower electrode and an upper electrode arranged on the piezoelectric film, and a means for applying energy to the piezoelectric element so as to bend the diaphragm for deforming a volume of the liquid chambers to spray the liquid. The liquid chambers have a pitch equal to the pitch of the nozzles, and the following relationships are satisfied:

$$10 \leqq W/L \leqq 150 \quad 1)$$

$$tp \geqq tv \quad 2)$$

$$0.012 \leqq (tp+tv)/L < 0.08 \quad 3)$$

where L is a length of the liquid chambers in an array direction, W is a length of the liquid chambers in a depth direction, tp is a thickness of the lead zirconate titanate film and tv is a thickness of the diaphragm.

By using this configuration, not only is the liquid spray efficiency superior, the nozzle density can be increased and the liquid spray head can be made more compact and integrated.

According to another aspect of the present invention, a configuration is employed in which the substrate on which the liquid chambers are formed is fabricated from planar oriented (110) monocrystalline silicon and the depth direction of the liquid chambers is in the <I12> or <I12> direction. By this means, the liquid chamber dimensions can be made more precise.

According to a further aspect of the present invention, the liquid spray is also configured such that the relationship between the upper electrode length Lu in the array direction of the liquid chambers, the PZT length Lp in the array direction of the liquid chambers, and the lower electrode length L1 in the array direction of the liquid chambers is $$Lu \leqq Lp < L1$$

By this means, a piezoelectric element can be configured that avoids problems in the production process and suppresses leakage current.

According to an additional aspect of the present invention, the liquid spray head is also configured such that the length L in the array direction of the liquid chambers and the length Lu of the upper electrode in the array direction of the liquid chambers have the relationship $$L > Lu$$

Since this makes it possible to efficiently deform the diaphragm, liquid spray can be performed more efficiently than conventionally possible.

According to still another aspect of the present invention, the liquid spray head is also configured such that the relationship between the upper electrode length Wu in the depth direction of the liquid chambers, the PZT length Wp in the depth direction of the liquid chambers, the lower electrode length W1 in the depth direction of the liquid chambers and the depth direction length W of the liquid chambers is $$W < Wu < Wp < W1$$

By this means, problems are avoided in the production process and a piezoelectric element can be configured that suppresses leakage current. Further, leading an electrode from the upper electrode can be easily performed.

According to still a further aspect of the present invention, the liquid spray head is also configured such that the Young's modulus of the diaphragm is greater than $1\times10^{11}$ $N/m^2$. This increases the amount of deformation of the diaphragm and facilitates liquid spray operation with sufficient margin. More particularly, if the Young's modulus of the diaphragm is greater than $2\times10^{11}$ $N/m^2$, deformation of the diaphragm can be greatly increased and the length W in the depth direction of the liquid chamber can be reduced, whereby the liquid spray head can be made more compact and faster.

A suitable material for use as the diaphragm is one that contains one or two or more of silicon nitride, titanium nitride, aluminum nitride, boron nitride, tantalum nitride, tungsten nitride, zirconium nitride, zirconium oxide, titanium oxide, aluminum oxide, silicon carbide, titanium carbide, tungsten carbide or tantalum carbide as the principal component(s).

It is also desirable that the diaphragm be configured with a laminated structure comprising a material layer with a Young's modulus of $1\times10^{11}$ $N/m^2$ or greater (more desirably $2\times10^{11}$ $N/m^2$ or greater) and a silicon oxide layer and that the silicon oxide layer be disposed at least above or below the material layer. By this means, adherence to the lower electrode or the substrate is strengthened, thus increasing production yield.

According to still an additional aspect of the present invention, a configuration is employed wherein a material layer containing aluminum oxide, zirconium oxide, stannic oxide, zinc oxide or titanium oxide as its principal component or a material layer containing two or more of the above materials as its principal components is inserted between the diaphragm and the lower electrode. This facilitates high temperature heat treatment and improves the piezoelectric characteristic of the PZT film.

According to yet another aspect of the present invention, the lower electrode may have a two-layer structure, wherein the layer in contact with the diaphragm is titanium and the layer in contact with the PZT is platinum or a platinum-containing alloy and the thickness of the titanium is less than 80 Å. By this means, it is possible to improve the breakdown voltage of the PZT film.

According to yet a further aspect of the present invention, the first substrate, which comprises liquid chambers and diaphragms and piezoelectric elements formed in that order so they cover the openings of the liquid chambers, and the second substrate in which the liquid paths are formed are joined into a single unit so that the liquid chambers formed in the first substrate and the liquid paths formed in the second substrate are contiguous.

By this means, it is easy to control the shape and depth of the liquid paths and the shape of the intersections of the liquid paths and the liquid chambers can be made constant, thus raising the freedom of design while eliminating the causes of air bubbles and deviations in the liquid spray characteristic.

It is also desirable that a hydrophilic material be formed on the inside surfaces of the liquid chambers. By this means, when a water-based material is used as the liquid, the wetting characteristic between the liquid chambers and liquid paths and the liquid is improved and the generation of bubbles is reduced.

A configuration may also be employed wherein openings in the cross-section where the first substrate and the second substrate are joined are used as the nozzles. In accordance with such a configuration, the nozzle plate, which is normally an expensive separate part, can be eliminated. The nozzles may also be formed in the second substrate. Thus, the density of the nozzles can be advantageously increased.

According to still yet a further aspect of the present invention, a production method for forming a liquid spray head is provided comprising the step of forming a diaphragm on a first surface of a substrate. A piezoelectric element is formed by laminating a lower electrode, a piezoelectric film and upper electrode having a first surface arranged on the diaphragm, and a second surface of the piezoelectric element is protected. A liquid chamber is formed at a predetermined position on a second surface of the substrate.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference characters denote similar elements throughout the several views.

FIG. 8B is a cross-sectional view of the embodiment of FIG. 8A; and

FIG. 9 is a schematic view of a liquid spray recording device incorporating the liquid spray head of the present invention.

DETAILED DESCRIPTION OF THE PREFERRED EMBODIMENTS

Figure 1:
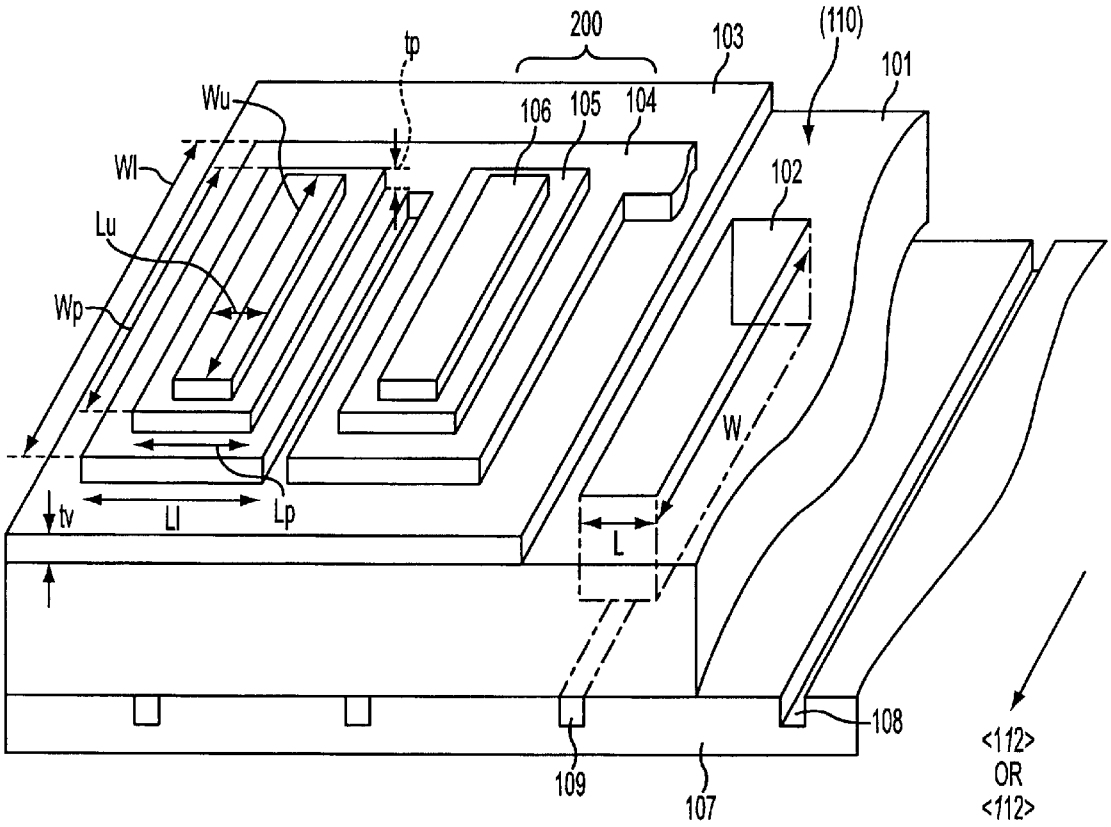
FIG. 1 is a perspective view of a liquid spray head in accordance with first and second embodiments of the present invention.

FIG. 9 is a schematic diagram of a liquid spray recording device 900 incorporating a liquid spray head 901 in accordance with the present invention.

As shown in FIG. 9, the liquid spray head 901 comprises plural nozzles and is connected to a conventional control circuit known in the art (not shown). The liquid spray head 901 is appropriately driven by such a control circuit so that ink is selectively sprayed on a recording medium 909, for example, recording paper, cloth, metal, resin wood or the like, positioned opposite thereto. The recording medium is pressed against platen 906 by a presser roller 907 and a feed roller 908. The liquid spray head 901 is configured so that characters, graphics and other information can be recorded on the recording paper 909. The liquid spray head 901 sprays an aggregate of dots formed from ink droplets to record the information on the recording medium.

A cartridge 902 in which ink is stored is connected to liquid spray head 901, and a guide rail 903 and a drive belt 904 are operatively connected to cartridge 902. When drive roller 905 rotates, drive belt 904 is driven, whereby liquid spray head 901 and cartridge 902 are moved in direction substantially parallel to the guide rail 903.

As noted above, the recording paper 909 is pressed against the platen 906 by the presser roller 907 and the feed roller 908. The liquid spray head 901 is moved in a direction substantially parallel to the guide rail 903. This direction is commonly referred to as the main scanning direction. When recording is completed for each scan, e.g. each time the liquid spray head is moved in the scanning direction, the feed roller 908 is incrementally rotated advancing the recording medium in a direction known as the subscanning direction. Ink is then sprayed from liquid spray head 901 is moved again in the scanning direction.

The liquid spray head in accordance with the present invention will now be discussed.

First Embodiment

Turning now to FIGS. 1 and 2, the first embodiment is shown therein. FIG. 1 is a perspective view of the liquid spray head in accordance with the first embodiment of the invention.

In FIG. 1, a spray head 100 comprises a first substrate 101, on which is formed diaphragm 103 fabricated on liquid chamber 102, and a piezoelectric element 200 consisting of lower electrode 104, piezoelectric film 105 and upper electrode 106. A second substrate 107, on which is formed liquid path 108, is joined together with the first substrate 101. The liquid path 108 is defined by a channel formed in the second substrate by conventional techniques. Nozzle 109 is formed in the opening in the cross-section where first substrate 101 and second substrate 107 are joined. Here, plural numbers of liquid chamber 102 and nozzle 109 are formed in arrays with the same pitch.

A brief explanation of the operation of the liquid spray head follows. A voltage is applied between lower electrode 104 and upper electrode 106. The voltage application deforms the piezoelectric element, comprising lower electrode 104, piezoelectric film 105 and upper electrode 106, and diaphragm 103 which reduces the volume of liquid chamber 102. As the volume of liquid chamber 102 is reduced the ink filled in liquid chamber 102 is pushed out into liquid path 108 causing the ink to be sprayed from nozzle 109.

Below is a detailed explanation of the liquid spray head of the invention and its production method according to the production process.

Figure 2A:
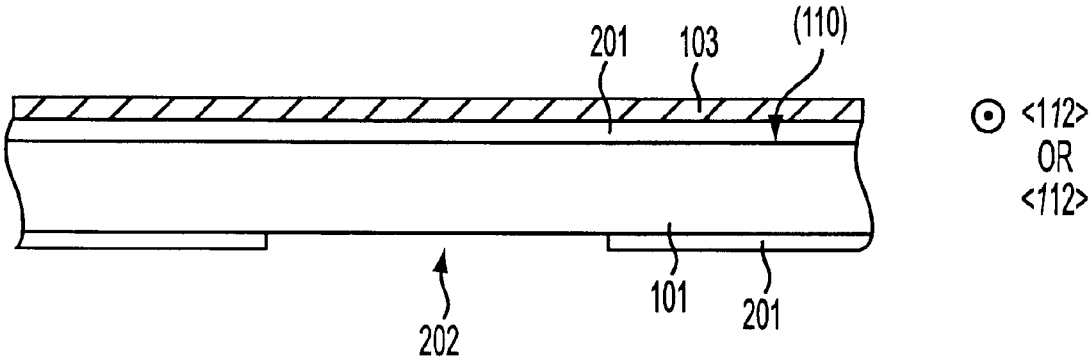
FIGS. 2A to 2C are cross-sectional views illustrating the production process of the liquid spray head of FIG. 1 up until the formation of a piezoelectric element and liquid chambers in a first substrate.
Figure 2B:
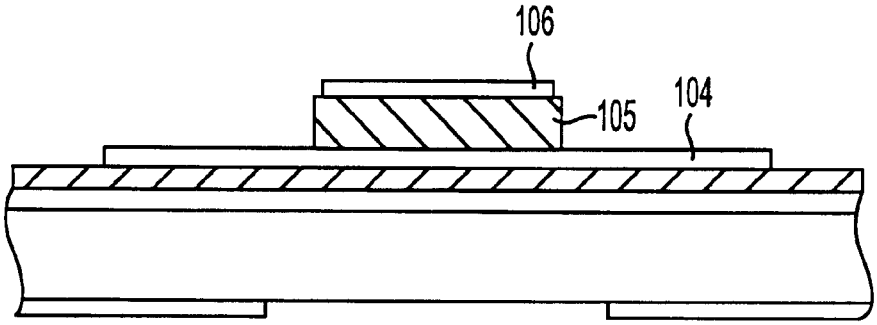
Figure 2C:
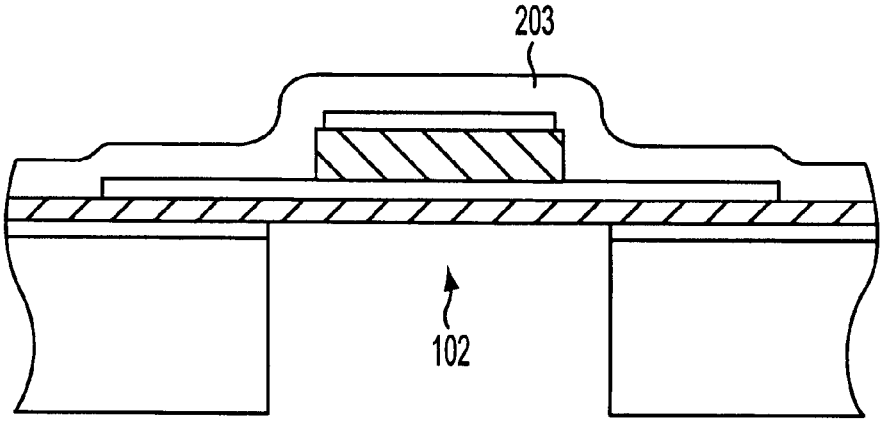

FIGS. 2A, 2B and 2C are cross-sectional views illustrating the production process up to the formation of the piezoelectric element and liquid chambers in the first substrate 101 of a liquid spray head according to the present invention. In this cross-sectional view, the direction perpendicular to the paper surface is referred to as the depth direction of the liquid chambers.

In the first step of this process the substrate 101 fabricated from planar oriented (110) monocrystalline silicon undergoes thermal oxidation at 1200° C., resulting in the formation of silicon oxide layers 201 on both sides of substrate 101. The silicon oxide layers preferably each have a thickness of 5000 Å. Next, the diaphragm 103 is formed on one side of substrate 101 by forming silicon nitride, for example, to a thickness of 1 μm by a plasma enhanced chemical vapor deposition (PECVD) method and heat treating it in a nitrogen atmosphere at a temperature of 800° C. A photoresist is then formed on both sides of the substrate 101, openings are made in the surface opposite the side on which the diaphragm 103 is formed, the silicon oxide layer 201 is patterned by an aqueous solution of hydrofluoric acid and ammonium fluoride, and opening 202 is formed. FIG. 2A illustrates the cross-section of such a semiconductor device. The depth direction, i.e., direction perpendicular to paper surface, of the opening 202 at this time is fabricated in either direction <1I2> or <I12>.

Referring to FIG. 2B, lower electrode 104 is formed on diaphragm 103 by forming a titanium layer having a thickness of 50 Å and a platinum layer having a thickness of 2000Å by a sputtering technique and then patterning with an aqua regia aqueous solution. Next, a PZT film is formed as piezoelectric film 105 by sputtering to a thickness 3 μm and is then patterned by an aqueous solution of hydrochloric acid. In recent years, various methods have been tried to form the PZT film, but the inventors utilize a sintered body target in which an excessive amount of lead oxide is added to PZT to which niobium had been introduced. Radio frequency sputtering is then conducted in an argon atmosphere without heating the substrate 101. After patterning the PZT film, heat treatment is performed in an oxygen atmosphere at 700° C., a titanium layer is formed having a thickness of 50 Å and a gold layer having a thickness of 2000 Å, in that order, as upper electrode 106 by a sputtering technique. Patterning is then performed with an aqueous solution of iodine and potassium iodide, resulting in the cross-section shown in FIG. 2(*b*).

As shown in FIG. 2C a protective film 203 is formed from, for example, photosensitive polyimide having a thickness of 2 μm, and the protective film on the electrode lead (not shown) is removed by developing, after which heat treatment is performed at 400° C. Next, the surface of the piezoelectric element side on which protective film 203 is formed is protected by a jig 300 shown in FIGS. 3(*a*) and (*b*) (described in detail below). The device is immersed in an aqueous solution of potassium hydroxide, whereby the monocrystalline silicon substrate 101 undergoes anisotropic etching at the vicinity of opening 202 in silicon oxide layer 201, and liquid chamber 102 is subsequently formed. Since the planar orientation of monocrystalline silicon substrate 101 is (110) at this time and the depth direction of opening 202 is <1I2> or <I12>, the surfaces of the side walls that make up the sides in the depth direction of liquid chamber 102 preferably comprise surface (111). When an aqueous solution of potassium hydroxide is used, the ratio of the etching rate of monocrystalline silicon surface (110) and surface (111) is about 300:1, which makes it possible to form a groove 300 μm deep while suppressing side etching to about 1 μm, thus forming the liquid chamber 102. Further, with substrate 101 still in the jig shown in FIGS. 3A and 3B, the silicon oxide in contact with the diaphragm 103 is removed by etching with an aqueous solution of hydrofluoric acid and ammonium fluoride.

In the preferred embodiment, after the liquid chamber 102 is formed in a condition in which protective film 203 is not attached, heat treatment can be performed again at 700° C. in an oxygen atmosphere and then the protective film formed. The treatment of the piezoelectric film (PZT film) 105 is repeated to improve its piezoelectric characteristic. A specific reason for this effect is not clear, but it is assumed that sintering of the PZT from which the piezoelectric film is formed progresses further and makes the crystalline grains larger, resulting in an increased piezoelectric distortion constant.

Figure 3B:
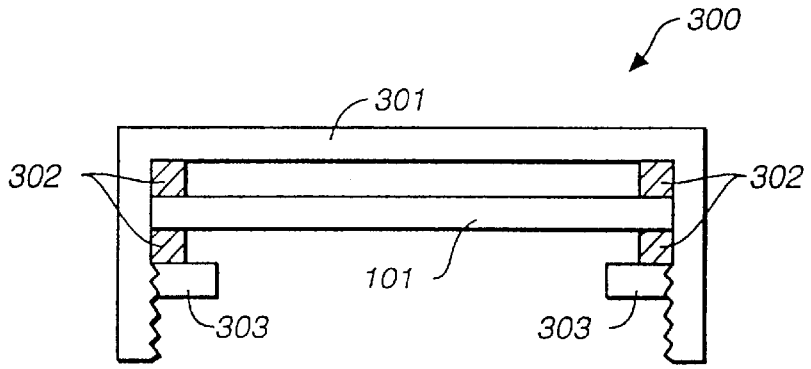
FIG. 3B is a cross-sectional view showing the substrate fixed in the jig of FIG. 3A.
Figure 3A:
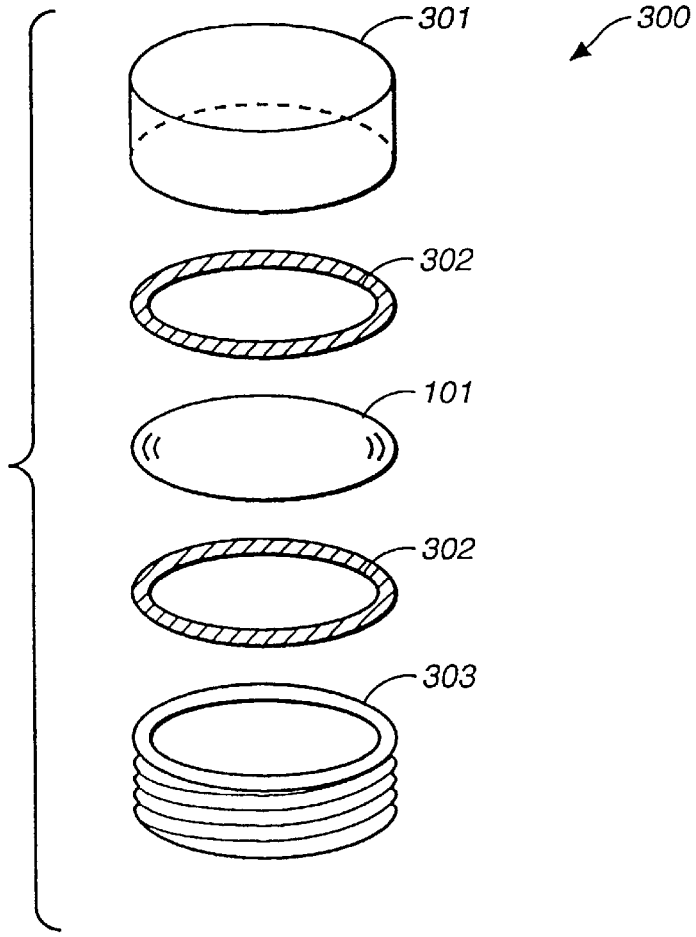
FIG. 3A is an exploded view a jig for protecting a surface of the piezoelectric element side during anisotropic etching of the substrate 101.

FIGS. 3A and 3B illustrates the jig 300 used in the preferred embodiment of the invention as described above to protect the surface on the piezoelectric element side during anisotropic etching of substrate 101. FIG. 3A illustrates the configuration of the jig 1 and FIG. 3B is a cross-sectional view showing substrate 101 mounted in the jig.

The jig 300 is configured such that one side is open, O-ring 302, the substrate 101 and O-ring 302 are inserted in cylindrical retainer frame 301, the inside surface of which is threaded, and anchor ring 303, the outside surface of which is threaded, is screwed into retainer frame 301, thus fixing the O-rings 302, the substrate 101 and anchor ring 303 in place. The surface of substrate 101 on which etching is to be performed, faces toward the opening of retainer frame 301. The assembly is then immersed in a potassium hydroxide aqueous solution or other etching solution as shown in FIG. 3B. Since the substrate 101 is sealed by anchor ring 303, O-ring 302, the etching solution can be prevented from coming in contact with the piezoelectric element side of substrate 101. In the preferred embodiment the Jig 300 is fabricated from polypropylene. Of course, as will be appreciated by one of ordinary skill in the art, the jig 300 may be made of any substrate material.

Figure 4:
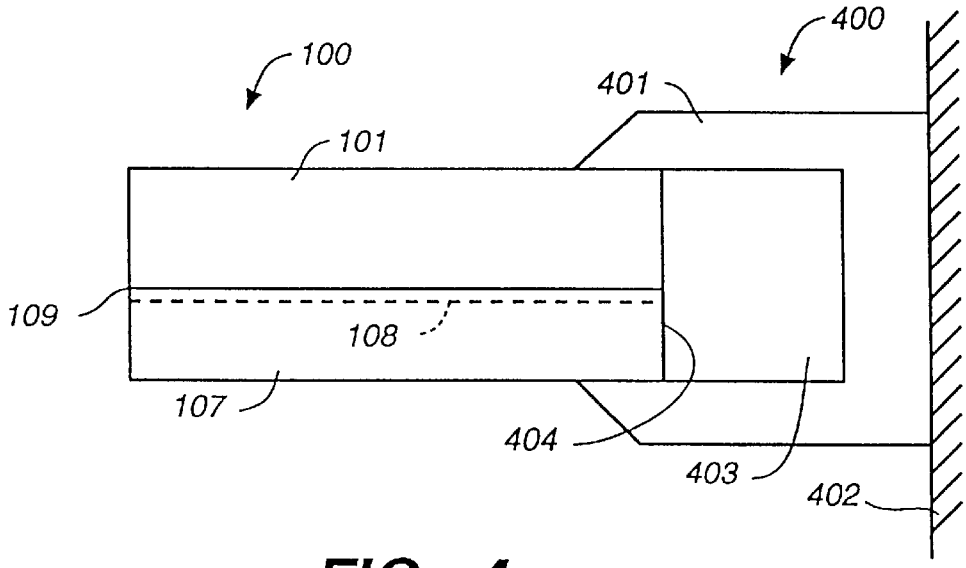
FIG. 4 is a schematic diagram of a mounting structure of the liquid spray head of FIG. 1.

Referring now to FIG. 4, a schematic diagram of a mounting structure 400 of the liquid spray head 100 is shown therein.

In FIG. 4 the first substrate 101 on which the piezoelectric element 200 and liquid chambers 102 are formed and the second substrate 107 on which liquid path 108 is formed are joined to form the nozzle 109 at a first end of the liquid spray head 100 and a liquid inlet port 404 at a second end of the liquid spray head 100. The second end of liquid spray head 100 is surrounded by base material 401, thus forming liquid chamber 403. The liquid chamber 403 functions as a reservoir for storing the liquid, such as ink, prior to being sprayed. As is readily appreciated, the liquid or ink is externally supplied to liquid chamber 403 (not shown) and the base material 401 is attached to mounting body 402 in a conventional manner. The second substrate 107 is formed as a unit with liquid path 108 by, for example, ejection molding of plastic.

The following is a discussion and an explanation of the relationship between the dimensions of the liquid chambers and the electrode, the thickness and dimensions of the piezoelectric film and the thickness of the diaphragm. The inventors gained much information by performing liquid spray experiments using the liquid spray head described above.

The inventors initially established the planar positional relationship for the liquid chamber 102, the lower electrode 104, the piezoelectric film 105 fabricated from PZT and upper electrode 106 as described.

First, the inventors conducted the production process as described above for the lower electrode 104, the piezoelectric film 105 and the upper electrode 106 up until the formation process of the upper electrode. At this stage, the inventors performed an evaluation.

The inventors found that when the upper electrode is larger than the lower electrode, the leakage current between the upper and lower electrodes is about two orders of magnitude greater than when compared to the lower electrode being larger than the upper electrode. This phenomenon is believed to be caused by the large leakage current of the PZT film at the edge of the lower electrode.

Further, in a case in which the lower electrode is larger than the upper electrode, the PZT film edge separated from the silicon nitride substrate when the PZT film was larger than the lower electrode. In contrast there was no separation when the PZT film was smaller than the lower electrode. This is believed to be caused by the poor adherence between the PZT film and the silicon nitride layer. Therefore, from the above results, a piezoelectric element can be configured in which there are no problems in the production process and leakage current is suppressed when the size relationship $$\text{upper electrode} \leqq PZT\ \text{film} < \text{lower electrode}$$

i.e., the size relationship $$Lu \leqq Lp < L1$$

where the upper electrode length in the array direction of the liquid chambers is Lu, the PZT length in the array direction of the liquid chambers is Lp and the lower electrode length in the array direction of the liquid chambers is L1. Additionally the following relation is satisfied:

$$Wu < Wp < W1$$

where the upper electrode length in the depth direction of the liquid chambers is Wu, the PZT length in the depth direction of the liquid chambers is Wp and the lower electrode length in the depth direction of the liquid chambers is W1, is satisfied.

The inventors also performed wire bonding on the upper electrode 106 after following the above described production process up until the formation of liquid chamber 102 in order to obtain electrode leads from upper electrode 106. When wire bonding was performed on upper electrode 106 immediately above liquid chamber 102, diaphragm 103 was damaged by pressure. However, when upper electrode 106 is extended in the depth direction of the liquid chambers, the size relationship $$W < Wu$$

where the length in the depth direction of the liquid chambers is W and the upper electrode length in the depth direction of the liquid chambers is Wu, is satisfied. Further, wire bonding may be performed without problem on that part of upper electrode 106 where substrate 101 exists below it (e.g. where liquid chamber 102 does not exist). Therefore, from the above results, electrode leads could be easily obtained from upper electrode 106 when $$W < Wu$$

The inventors then performed an optimizing experiment under the above condition Lu≦Lp<L1 by investigating the amount of deformation of diaphragm 103 in the middle of the liquid chamber with respect to the relationship with the length L in the array direction of liquid chamber 102. The materials and thicknesses of the diaphragm, lower electrode, PZT and upper electrode were as described above. Further, the center of the piezoelectric element was positioned in the center between the sides in the array direction of the liquid chambers so there was left-right symmetry. Also, the voltage applied between the upper and lower electrodes was 30 V. The results when L was fixed at 100 μm and Lu, Lp and L1 were varied are shown below in TABLE 1.

TABLE 1

| Lu (μm) | Lp (μm) | L1 (μm) | Amount of deformation (μm) |
|---|---|---|---|
| 106 | 112 | 118 | 0 |
| 82 | 112 | 118 | 0.5 |
| 82 | 88 | 118 | 0.7 |
| 82 | 88 | 94 | 0.7 |

As shown in the above table, the size relationship between liquid chamber 102 and PZT film 105 or lower electrode 104 in the array direction has little effect, if any, on the amount of deformation of the diaphragm. However, the size relationship between liquid chamber 102 and upper electrode 106 does have an effect on the amount of deformation of the diaphragm, and the amount of deformation of the diaphragm decreases if upper electrode 106 is larger than liquid chamber 102. According to this result, it should be possible to efficiently deform the diaphragm by including the deformation part of the piezoelectric element inside the liquid chamber. The planar positional relationship in the array direction of the liquid chambers which results in this condition is $$\text{length L in array direction of liquid chamber} > \text{upper electrode length Lu in the array direction of liquid chamber}$$

The inventors then performed a liquid spray experiment using the planar size relationship described above. They used a water-based ink as the liquid. Using length L (unit: μm) in the array direction of the liquid chamber, length W (unit: μm) in the depth direction of the liquid chamber, the PZT film thickness tp (unit: μm) and the diaphragm thickness tv (unit: μm) as parameters. The inventors measured the liquid spray velocity (unit: m/s) at a point 5 mm from nozzle 109. The electric field applied to the PZT film was set to 5 V/μm. The diaphragm material, the lower electrode material and thickness, the upper electrode material and thickness and the protective film material and thickness were as described above. The results of this study are shown below in TABLE 2.

TABLE 2

| L | W | tp | tv | Liquid spray velocity |
|---|---|---|---|---|
| 100 | 15000 | 0.8 | 0.4 | 5 |
| " | " | 0.7 | " | Does not spray |
| " | " | 3 | 1 | 15 |
| " | " | " | 3 | 17 |
| " | " | " | 5 | Does not spray |
| 200 | 2000 | 4 | 2 | 10 |
| " | 1000 | " | " | Does not spray |

Under the conditions L=100 μm, W=15000 μm and tv=0.4 μm, the liquid sprayed when tp=0.8 μm, but it did not spray when tp=0.7 μm. This is probably because the pressure applied to the liquid in the liquid chamber was insufficient when tp=0.7 μm. According to the strength of materials, the pressure applied to the liquid in the liquid chamber is generally proportional to the cube of tp+tv and inversely proportional to the cube of L. Therefore, when the above experimental results are confirmed to these conditions, the pressure applied to the liquid in the liquid chamber is sufficient to spray liquid if the following range is set.

$$(tp+tv)^3/L^3 \geqq 1.7\times10^{-6}$$

i.e., $$(tp+tv)/L \geqq 0.012$$

Also, the liquid spray characteristic can be expected to improve as the left side of the above inequality becomes large, and a liquid spray velocity of 17 m/s was actually recorded when tp=tv=3 μm.

Liquid was not sprayed, however, when tp=3 μm and tv=5 μm. This was because the rigidity of diaphragm 103 was increased due to its greater thickness, thus preventing it from deforming enough to spray the liquid. Therefore, it is not desirable for diaphragm 103 to be too thick, and when numerical conditions are fitted to the above inequality, $$(tp+tv)^3/L^3 < 5.12\times10^{-4}$$

i.e., $$(tp+tv)/L < 0.08$$

must be satisfied. This inequality implies that in order to shorten the length L in the array direction of the liquid chambers and to increase the density of the nozzles of the liquid spray head, the sum of the PZT thickness tp and the diaphragm thickness tv must be made small. In other words, L can be made smaller and the nozzle density increased by making tp+tv small.

It is possible to further increase the length W in the depth direction of the liquid chamber as a means for spraying liquid in this configuration (i.e., tp=3 μm and tv=5 μm). However, if a configuration such as this is used, the planar size of the liquid spray head becomes extremely large and deviates from any practical range. Also, when W is large, the liquid path resistance in the liquid chambers increases and the operating speed of the liquid spray head decreases. Therefore, in order to make the planar size of the liquid spray head compact and have a high speed operation, the above experimental results show that the conditions $$tp \geqq tv \text{ and } W/L < 150$$

should be satisfied.

Where L=200 μm, tp=4 μm and tv=2 μm, liquid is sprayed when W=2000 μm and was not sprayed when W=1000 μm. This is because the depth length of the liquid chamber is too short to spray liquid at W=1000 μm. Therefore, the inventors found that the condition W/L≧10 must be satisfied when the liquid chambers and nozzles are disposed in a high density array where L≦200 μm.

The features and advantages of the liquid spray head described above are listed below.

By using PZT for the piezoelectric film 105, the liquid spray efficiency is good. PZT has one of the largest piezoelectric constants among piezoelectric materials, and $d_{31}$= 150 pC/N was achieved in the PZT film in the preferred embodiment. The PZT of the invention is not limited with respect to its composition, the type and amount of additive added in the preferred embodiment described above or the type and amount of compounds that can be dissolved in the above embodiment. Also, the formation methods are not limited to those described above.

Since the array pitch of liquid chamber 102 is the same as the array pitch of nozzle 109, no space is required to lead liquid path 108 connecting the liquid chambers and the nozzles, thus making it possible to make the liquid spray head more compact and to avoid making the liquid spray head larger even if the number of nozzles is increased.

A liquid spray head satisfying the conditions 10≦W/L≦150, tp≧tv and 0.012≦(tp+tv)/L<0.08, can have liquid spray is possible even if narrow liquid chambers are formed using a thin diaphragm 103 and the PZT film 105. This arrangment facilitating a compact liquid spray head with a high nozzle density.

Additionally, such a device having planar oriented (110) monocrystalline silicon for substrate 101 and making the depth direction of liquid chamber 102 direction <1$\bar{1}$2> or <$\bar{1}$12>, the surfaces of the side walls that form the sides in the depth direction of liquid chamber 102 can be made (111) surfaces, thus making it possible to form 300-μm-deep liquid chambers while suppressing side etching in the array direction of the liquid chambers to about 1 μm. Therefore, the dimensional accuracy of the liquid chambers is increased.

By satisfying the condition Lu≦Lp<L1, a piezoelectric element in which leakage current is suppressed can be configured without encountering any problems in the production process, and by satisfying the condition L>Lu, the diaphragm can be deformed efficiently, thus resulting in efficient liquid spray, and by satisfying the condition W<Wu<Wp<W1, it is possible to configure a piezoelectric element in which leakage current is suppressed while also making it easier to fabricate the upper electrode.

In a configuration according to the present invention in which the first substrate 101, on which the piezoelectric element 200 and liquid chamber 102 are formed, and the second substrate 107, on which liquid path 108 is formed, are mated together in a single unit such that the liquid chamber and liquid path are contiguous, it is easier to control the shape and depth of the liquid paths and the shape of the junction point of the liquid paths and the liquid chambers 102. As a result of this arrangement, the freedom of design is increased and the cause of bubbles and deviations in the liquid spray characteristic is substantially removed.

Moreover, a liquid spray head having openings in the cross-section where first substrate 101 and second substrate 107 which are joined to form nozzles, an expensive nozzle substrate, which was required as a separate component in conventional spray heads, is no longer necessary.

In a production method according to the preferred embodiment that provides a means for protecting the side surfaces after forming the piezoelectric element and forms the liquid chambers from the surface on the opposite side, it is possible to form a liquid spray head having significantly good improved yields even though a thin diaphragm and PZT are employed. In this embodiment, the means for protecting the surface on the piezoelectric element side is a jig, but the means is not limited to this and other means may be used such as applying a thick layer of photoresist.

In accordance with the preferred embodiments, a production method that joins second substrate 107 on which the liquid paths are formed to the liquid chamber opening side of first substrate 101 on which the liquid chambers are formed, one substrate (second substrate) is used to seal substrate 101, whereby only one adhering process is required, which lowers the cost of the liquid spray head.

In the accordance with the preferred production method that forms silicon oxide layer 201 on substrate 101 and removes silicon oxide layer 201 in contact with liquid chamber 102 in the same process or after the process that forms liquid chamber 102, it is possible to prevent splitting or separation of diaphragm 103 in the production process, thus increasing the production yield of the liquid spray head. Further, it is possible to remove the effect of any remaining silicon oxide layer 201 when the diaphragm is vibrated, thus improving the liquid spray characteristic.

Second Embodiment

In order to investigate the material of diaphragm 103, the inventors changed the diaphragm material in the structure in FIG. 2C and investigated the amount of deformation of the diaphragm at the middle portion of the liquid chamber. The inventors used a configuration in which lower electrode 104 was not patterned at all and was present over the entire surface of substrate 101. The conditions examined were L=100 μm, Lp=94 μm, Lu=88 μm, W=15 mm, tp=3 μm and tv=1 μm, and a voltage of 30 V was applied between the upper and lower electrodes.

In addition to the silicon nitride used in the first embodiment, the materials used for diaphragm 103 include silicon oxide formed by a thermal oxidation method, silicon which has undergone $10^{21}$ $cm^{-3}$ thermal diffusion with boron, and zirconium oxide and aluminum oxide formed by a sputtering method. The results are shown in TABLE 3 below.

TABLE 3

| Diaphragm material | Young's Modulus ($\times 10^{11}$ $N/m^2$) | Amount of deformation (μm) |
|---|---|---|
| Silicon oxide | 0.7 | 0.2 |
| Silicon | 1.7 | 0.5 |
| Zirconium oxide | 2.7 | 0.6 |
| Silicon nitride | 3.1 | 0.7 |
| Aluminum oxide | 3.9 | 0.9 |

Based on the above results, the larger the Young's modulus of diaphragm 103, the greater the deformation of the diaphragm. This indicates that if the Young's modulus of diaphragm 103 is small, the piezoelectric film extends greatly in the lateral direction while its deformation in the longitudinal direction is small when it is deformed in the lateral direction. In order to efficiently deform the diaphragm and spray liquid, it is necessary to use a diaphragm with a large Young's modulus.

When the approximate expulsion volume of the liquid chamber by diaphragm 103 is estimated from the above results, it becomes $1.5\times10^{-13}$ $m^3$ when silicon oxide is used, which is just enough expulsion volume to perform liquid spray when using a water-based ink. Therefore, by making the Young's modulus of the diaphragm greater than $1\times10^{11}$ $N/m^2$, liquid spray can be performed with sufficient margin, and particularly by making it greater than $2\times10^{11}$ $N/m^2$, the amount of deformation of the diaphragm increases markedly and the length W in the depth direction of the liquid chamber can be decreased. In accordance with this embodiment, the liquid spray head can be manufactured more compactly having an increased operating speed.

From the above results, it can be seen that it is desirable to use zirconium oxide, silicon nitride or aluminum oxide with a large Young's modulus as the diaphragm material. In addition to these materials, titanium nitride, aluminum nitride, boron nitride, tantalum nitride, tungsten nitride, zirconium nitride, titanium oxide, silicon carbide, titanium carbide, tungsten carbide and tantalum carbide with a Young's modulus greater than $2\times10^{11}$ $N/m^2$ may be substituted as diaphragm materials.

Further, other components may be added to the above materials used as principal components, or two or more of the above materials may be combined. For example, cemented carbide may be used for the diaphragm in which minute amounts of titanium carbide, tantalum carbide and cobalt are added to tungsten carbide as the principal component or a element may be used in which minute amounts of impurities are added to tungsten carbide or tungsten carbide nitride.

Third Embodiment

Figure 5:
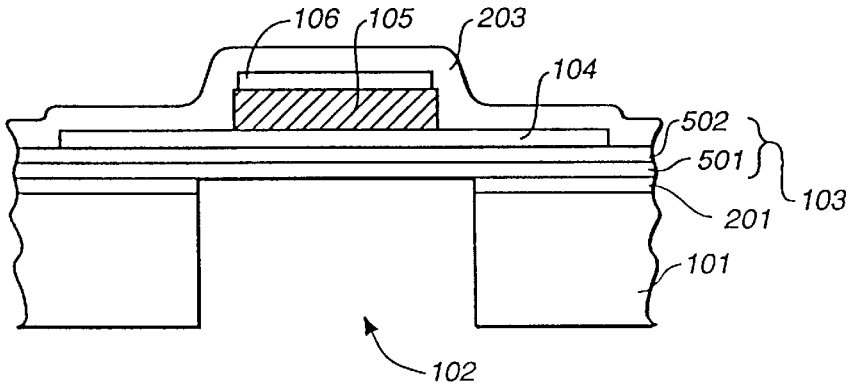
FIG. 5 is a cross-sectional view of a third embodiment of the present invention in which the piezoelectric element and the liquid chambers have been formed in a liquid spray head whose diaphragm has a laminated structure.

FIG. 5 is a cross-sectional view of a substrate on which the piezoelectric element and liquid chamber are formed in a liquid spray head with a structure in which the diaphragm 103 is a laminated structure comprising layers 501 and 502 in accordance with a third embodiment of the invention.

In that figure, reference numeral 501 denotes a material layer having a Young's modulus of greater than $1\times10^{11}$ $N/m^2$ and more preferably greater than $2\times10^{11}$ $N/m^2$. Layer 501 is preferably constituted by the same silicon nitride as discussed above in the first embodiment. Silicon oxide layer 502 is formed continuously after silicon nitride layer 501 is formed by a plasma enhanced chemical vapor deposition process (PECVD). Other components are similar to those described in the first embodiment.

The adhesion between lower electrode 104 and the diaphragm is strengthened by providing this silicon oxide layer 502. Also, the production yield can be increased because it is possible to relax the stress applied to PZT film 105 during thermal treatment in the production process. The liquid spray characteristic when the silicon nitride layer 501 was 1 μm and silicon oxide layer 502 was 1000 Å did not differ from that shown in TABLE 2 in the first embodiment and there was no degradation of the liquid spray characteristic by adding silicon oxide layer 502.

This embodiment is suitable for treatment temperatures of less than 710° C. during or after formation of the PZT film. This is because the lead in the PZT film diffuses through lower electrode 104 to silicon oxide layer 502 of the diaphragm. Normally, silicon oxide is in a solid state in this temperature range, but silicon oxide into which lead has diffused becomes a liquid at temperatures above 714° C., and this is sprayed outside the head and destroys the liquid spray head.

Fourth Embodiment

Figure 6:
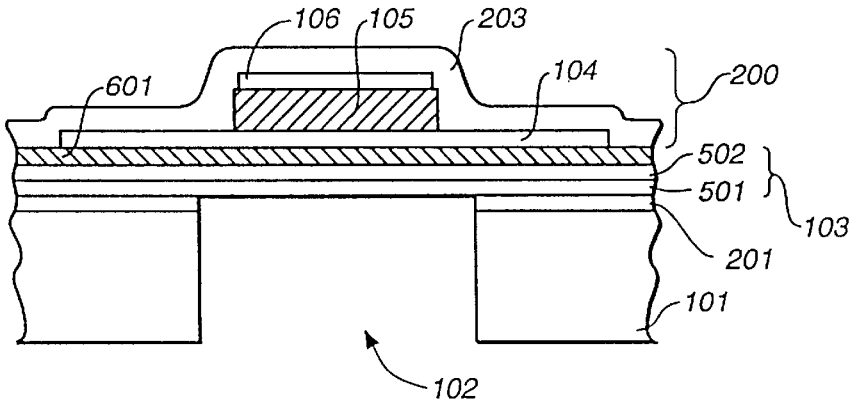
FIG. 6 is a cross-sectional view of fourth and fifth embodiment of the present invention in which the piezoelectric element and liquid chambers have been formed in a liquid spray head in which an aluminum oxide layer has been inserted between the diaphragm and the lower electrode.

FIG. 6 is a cross-sectional view of a substrate 101 on which a piezoelectric element 200 and a liquid chamber 102 are formed in a liquid spray head 101 in which an aluminum oxide layer 601 is inserted between the diaphragm and lower electrode.

As shown in the FIG. 6, the aluminum oxide layer 601 is formed on the diaphragm 103, which is constituted by the silicon nitride layer 501 and the silicon oxide layer 502, by a sputtering method to a thickness of 1000 Å, and the lower electrode 104 is formed above the aluminum oxide layer 601. The fourth embodiment is similar to the third embodiment in other respects.

By forming the aluminum oxide layer 601, diffusion of lead in the PZT to the diaphragm 103 as described in the third embodiment above can be suppressed. By this means, damage to the liquid spray head due to the spraying of silicon oxide layer 502 to outside the head can be prevented even if high temperature heat treatment above 710° C. is performed, thus increasing the production yield of such liquid spray heads. Further, since it is possible is perform efficient high temperature heat treatment at temperatures above 710° C., the piezoelectric characteristic of the PZT film can be further improved, thus also improving the liquid spray characteristics.

It was shown that the effect achieved by providing aluminum oxide layer 601 can also be achieved by using other materials. The results of experiments confirmed the same effects were obtained when zirconium oxide, stannic oxide, zinc oxide or titanium oxide was substituted for aluminum oxide. Further, materials in which compounds are added to any of these as the principal components or two or more of these are used as principal components can be similarly applied. This effect was also confirmed in not only a diaphragm configuration with a silicon oxide layer on the surface but also in a monocrystalline silicon diaphragm in which boron was mixed.

Fifth Embodiment

The inventors performed the following experiment in order to determine the configuration of lower electrode 104.

Titanium and platinum were continuously formed in that order as lower electrode 104 on the monocrystalline silicon substrate 101 provided with the silicon oxide layer 201. The platinum thickness was 2000 Å and the titanium thickness was varied from 50 Å to 1000 Å. The titanium layer was provided for increasing the adhesion between the platinum of the electrode 104 and the silicon oxide layer 201 of the diaphragm 103.

The PZT layer 105 was than formed on top of electrode 104 with a thickness of 1 $\mu$m by the method shown in the first embodiment, heat treatment was performed for 4 hours at 600° C. in an oxygen atmosphere, and aluminum was formed as the upper electrode 106 by mask deposition in a 3-mm square size.

The inventors applied a voltage between the upper and lower electrodes in this sample and evaluated the breakdown voltage characteristic of the PZT film. Here, the breakdown voltage of the PZT film was defined as the voltage applied when the leakage current became 100 nA. The results are shown in TABLE 4.

TABLE 4

| Titanium thickness (Å) | Breakdown voltage (V) |
|---|---|
| 1000 | 8 |
| 200 | 14 |
| 100 | 18 |
| 80 | 30 |
| 50 | 50 |

The above results indicate that the titanium film thickness is inversely proportional to the breakdown voltage of the PZT film. In other words, the breakdown voltage rose as the titanium film thickness became thinner. The inventors also observed that minute protrusions occurred on the platinum surface and that the density of the protrusions increased as the titanium film became thicker. For example, a density of 20,000/mm$^2$ was observed at a titanium film thickness of 50 Å, while a density 210,000/mm$^2$ was observed at a titanium film thickness of 200 Å. Based on this finding, the minute protrusions formed on the platinum surface by heat treatment were thought to lower the breakdown voltage of the PZT film.

By lowering the titanium film thickness from 100 Å to 80 Å, the breakdown voltage of the PZT film was greatly increased from 18 V to 30 V. As the breakdown voltage of the PZT film is increased, the voltage that can be applied can therefore be increased, thus making it possible to improve the liquid spray characteristic in the liquid spray head. It also becomes possible to spray liquid when the PZT film is thin and to improve productivity in production.

As is understood by one of ordinary skill in the art, a breakdown voltage of less than 10 V is too low to withstand practical application, and even 20 V is still insufficient. However, a breakdown voltage that greatly exceeds 20 V is considered to be in the practical range. According to the above experimental results, the breakdown voltage of the PZT film increases markedly when the titanium film thickness is below 80 Å. Therefore, the titanium film thickness should be less than 80 Å, and in the above embodiment the inventors used a titanium film thickness of 50 Å.

In the above embodiment, the electrode material provided on top of the titanium whose thickness is less than 80 Å was platinum, but this may be an alloy containing platinum. The inventors used a sputtering method to continuously form titanium to a thickness of 50 Å and then an alloy of 70% platinum and 30% iridium on a monocrystalline substrate with a silicon oxide layer 201 and then performed heat treatment at 600° C. for 4 hours in an oxygen atmosphere. The inventors observed the alloy surface after heat treatment under a microscope at a magnification of 800 and did not observe any of the above described minute protrusions on the surface. When the inventors formed the PZT film and measured its breakdown voltage as in the above embodiment, the result was 70 V, which was a further improvement of the characteristic.

The material for the diaphragm is not limited to monocrystalline silicon with a silicon oxide layer, and any suitable materials mentioned in the above embodiments may be used.

Sixth Embodiment

Figure 7:
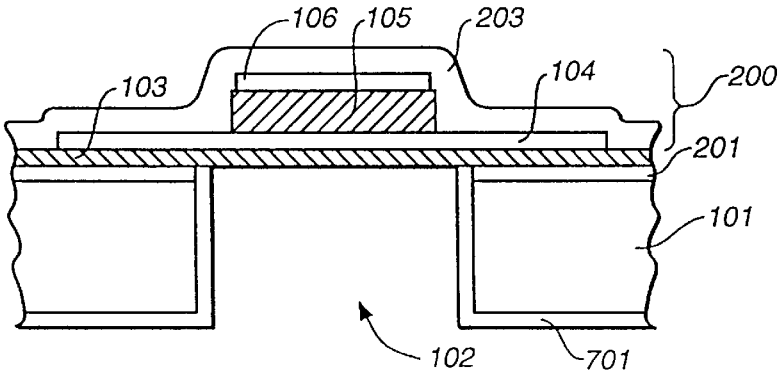
FIG. 7 is a cross-sectional view of a sixth embodiment of the present invention in which the piezoelectric element and liquid chambers have been formed in a liquid spray head in which a layer of hydrophilic material has been formed on the inside surfaces of the liquid chambers.

FIG. 7 is a cross-sectional view of a substrate 101 on which a piezoelectric element 200 and liquid chamber are formed in a liquid spray head in which a hydrophilic material layer 710 is formed on the inside surface of the chamber.

As shown in FIG. 7, a hydrophilic material layer is formed on the inside surface of the chamber 701 by anisotropic etching of the monocrystalline silicon substrate 101 and then thermal oxidation of the surface of substrate 101 at a temperature of about 800° C. is conducted prior to forming protective film 203. Following this, protective layer 203 is formed on the surface of substrate 101 which the piezoelectric element 200 is formed.

The method by which hydrophilic material layer 701 is formed may a spin-on-glass (SOG) method or other method whereby silicon oxide 201 is also coated below diaphragm 103, or a liquid in which particles of a hydrophilic material are mixed is flowed in the liquid paths and the liquid chambers after assembly of the liquid spray head. The particles of the hydrophilic material are then left on the surfaces of the liquid paths and the liquid chambers.

When this configuration is employed, wetting of the liquid in the liquid chambers and liquid paths is improved and the generation of bubbles is reduced when a water-based ink or other water-based material is used as the liquid. By also using glass or other hydrophilic material on second substrate 107, the wetting effect is further improved.

Seventh Embodiment

Figure 8A:
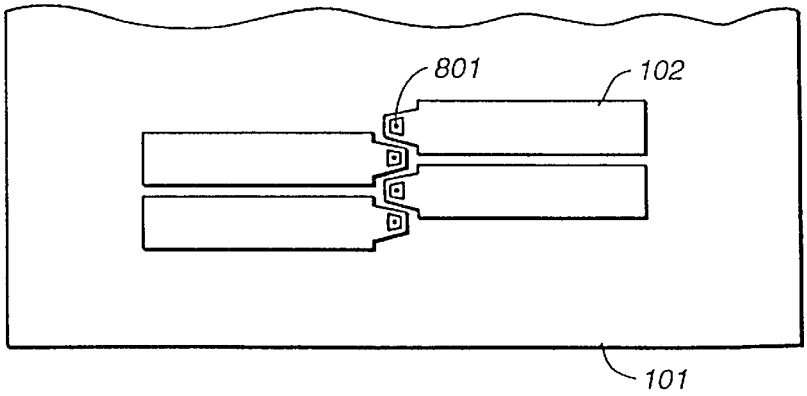
FIG. 8A is a plan view of a liquid spray head in which nozzles have been formed in second substrate in accordance with a seventh embodiment of the present invention.

FIG. 8A is a plan view and FIG. 8B is a cross-sectional view of a liquid spray head in which nozzles are formed on second substrate 107, in accordance with a seventh embodiment of the present invention.

In the figure, nozzle 801 is formed on second substrate 107 on which a liquid path 108 is formed, and the second substrate 801 is joined to the first substrate 101 by conventional techniques. Nozzle 801 can then be formed by irradiating the second substrate 107 an excimer laser, or any similar device.

As a result of such configuration, liquid chambers 102 can be positioned in a staggered arrangement and nozzles 801 can be positioned on a straight line. Therefore, the array pitch of nozzles 801 can be made half the array pitch of liquid chambers 102. Accordingly, when the liquid chamber dimension is made 100 $\mu$m as in the first embodiment above, nozzles 801 can be arrayed in a density of about 400 DPI. That is, nozzles 801 can made more dense. Since the nozzles are arrayed on a straight line, high quality printing can be performed without shifted dots when ink or other liquid is recorded on paper or other medium.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A production method for forming a liquid spray head comprising the steps of:

(a) forming a diaphragm on a first surface of a substrate made of planar oriented (110) monocrystalline silicon;

(b) forming a piezoelectric element by laminating a first electrode, a piezoelectric film and a second electrode arranged on the diaphragm;

(c) patterning at least the second electrode and the piezoelectric film into a predetermined shape;

(d) protecting the piezoelectric element and the first surface of the substrate;

(e) defining a direction in which a liquid chamber of the liquid spray head is to be extended as one of <1I2> direction and <I12> direction; and (f) forming the liquid chamber at a predetermined position on a second surface of the substrate, which opposes the first surface thereof, by etching, wherein said steps (a) through (f) are performed in the stated order.

2. The production method for a liquid spray head of claim 1, further comprising the steps of:

forming a liquid path in a second substrate; and joining the second substrate with the second surface of the first substrate.

3. The production method for a liquid spray head of claim 1, further comprising the steps of:

forming a silicon oxide layer on the substrate; and removing the silicon oxide layer in contact with the liquid chamber by one of (1) etching the silicon oxide layer while forming the liquid chamber and (2) etching the silicon oxide layer after forming the liquid chamber.

4. The production method for a liquid spray head of claim 1, wherein said step of forming the piezoelectric element further comprises the steps of:

heat treating the piezoelectric film; and reheating the piezoelectric film after the liquid chambers have been formed in the substrate.

5. The production method of claim 1, wherein the protecting step is performed using a jig.

6. The production method of claim 1, wherein the protecting step is performed by forming a protective film which covers the piezoelectric element entirely.

7. A production method for forming a liquid spray head comprising the steps of:

(a) forming a diaphragm on a first surface of a substrate;

(b) forming a piezoelectric element by laminating a first electrode, a piezoelectric film and a second electrode arranged on the diaphragm;

(c) patterning at least the second electrode and the piezoelectric film into a predetermined shape;

(d) protecting the piezoelectric element and the first surface of the substrate; and (e) forming a liquid chamber at a predetermined position on a second surface of the substrate, which opposes the first surface thereof; by etching, wherein said steps (a) through (e) are performed in the stated order.

8. The production method of claim 7, further comprising the steps of:

forming a liquid path in a second substrate; and joining the second substrate with the second surface of the first substrate.

9. The production method of claim 7, wherein the protecting step is performed using a jig.

10. The production method of claim 7, wherein the protecting step is performed by forming a protective film which covers the piezoelectric element entirely.

11. A production method for forming a liquid spray head comprising the steps of:

forming a silicon oxide layer on a first surface of a substrate;

forming a diaphragm on the silicon oxide layer;

forming a piezoelectric element by laminating a first electrode, a piezoelectric film and a second electrode arranged on the diaphragm;

protecting the piezoelectric element and the first surface of the substrate;

forming a liquid chamber at a predetermined position on a second surface of the substrate, which opposes the first surface thereof, by etching; and removing the silicon oxide layer in contact with the liquid chamber either by etching the silicon oxide layer while forming the liquid chamber or etching the silicon oxide layer after forming the liquid chamber.

12. The production method of claim 11, wherein the protecting step is performed using a jig.

13. A production method for forming a liquid spray head comprising the steps of:

(a) forming a diaphragm on a first surface of a substrate;

(b) forming a piezoelectric element by laminating a first electrode, a piezoelectric film and a second electrode arranged on the diaphragm;

(c) heat treating the piezoelectric film;

(d) protecting the piezoelectric element and the first surface of the substrate;

(e) forming a liquid chamber at a predetermined position on a second surface of the substrate, which opposes the first surface thereof, by etching; and (f) reheating the piezoelectric film after the liquid chamber has been formed in the substrate, wherein said steps (a) through (f) are performed in the stated order.

14. The production method of claim 13, wherein the protecting step is performed using a jig.

* * * * *